US006393657B1

(12) United States Patent
Zimet

(10) Patent No.: US 6,393,657 B1
(45) Date of Patent: May 28, 2002

(54) BRUSH ROLL ROTATION INDICATOR

(75) Inventor: Dnaiel B. Zimet, South Euclid, OH (US)

(73) Assignee: The Scott Fetzer Company, Westlake, OH (US)

( * ) Notice: Subject to any disclaimer, the term of this patent is extended or adjusted under 35 U.S.C. 154(b) by 0 days.

(21) Appl. No.: 09/584,758

(22) Filed: May 31, 2000

(51) Int. Cl.[7] ..... A47L 9/00
(52) U.S. Cl. ..... 15/339; 15/319
(58) Field of Search ..... 15/339, 319

(56) References Cited

U.S. PATENT DOCUMENTS

| | | | | |
|---|---|---|---|---|
| 3,253,295 | A | 5/1966 | Waters | 15/339 |
| 4,163,999 | A | 8/1979 | Eaton et al. | 15/391 |
| 4,245,370 | A | 1/1981 | Baker | 15/391 |
| 4,328,522 | A | 5/1982 | Tryan | 15/391 |
| 4,370,690 | A | 1/1983 | Baker | 15/391 |
| 4,398,231 | A | 8/1983 | Currence | 15/391 |
| 4,403,372 | A | 9/1983 | Keane et al. | 15/391 |
| 4,637,092 | A | 1/1987 | Hayashi et al. | 15/319 |
| 4,654,924 | A | 4/1987 | Getz et al. | 15/319 |
| 4,692,754 | A | 9/1987 | Edejer et al. | 15/319 |
| 4,706,327 | A | 11/1987 | Getz et al. | 15/319 |
| 4,728,942 | A | 3/1988 | England | 15/339 |
| 4,731,898 | A | 3/1988 | Sovis et al. | 15/339 |
| 4,847,944 | A | 7/1989 | Lackner | 15/392 |
| 4,955,103 | A | 9/1990 | Scott et al. | 15/319 |
| 5,014,387 | A | 5/1991 | Hays | 15/339 |
| 5,038,484 | A | 8/1991 | Rench et al. | 15/339 |
| 5,056,175 | A | 10/1991 | Stein et al. | 15/339 |
| 5,193,243 | A | 3/1993 | Stegens | 15/391 |
| 5,373,598 | A | 12/1994 | Weber et al. | 15/339 |

*Primary Examiner*—Robert J. Warden, Sr.
*Assistant Examiner*—Theresa T. Snider
(74) *Attorney, Agent, or Firm*—Jones, Day, Reavis & Pogue

(57) ABSTRACT

A magnet is attached to a vacuum cleaner brush roll in a position to provide brush bristles on both sides of the magnet along the length of the brush roll. The magnet is attached to the brush roll in a recess that may be a circumferential groove or a bore, and the magnet is aligned with a front-to-rear rib on a carpet plate.

33 Claims, 10 Drawing Sheets

BRUSH ROLL ROTATION INDICATOR

BACKGROUND OF THE INVENTION

This application relates to the art of indicators and, more particularly, to indicators that provide a visual or electrical signal to confirm that an element is rotating, or to measure the speed of rotation. The invention is particularly applicable to a magnetically operated indicator for indicating that a vacuum cleaner brush roll is rotating and will be described with specific reference thereto. However, it will be appreciated that certain features of the invention have broader aspects and may be used for other purposes or in other environments.

In a known type of indicator for confirming the rotation of a vacuum cleaner brush roll, one or more magnets are attached to the brush roll for rotation therewith. During rotation of the brush roll, magnetic flux cooperates with a coil attached to the vacuum cleaner housing adjacent the magnets for producing a voltage that energizes a light. In most arrangements of this type, the magnets are mounted at one end of the brush roll which is devoid of brush bristles. The absence of brush bristles at one end portion of the brush roll provides ineffective edge cleaning and also reduces protection against entry of strings or threads into the bearing at the end of the brush roll. In other arrangements where the magnet is not at the end of the brush roll, there is no indication of how the magnets are attached to the brush roll.

SUMMARY OF THE INVENTION

In accordance with the present application, a brush roll has a cylindrical outer surface with a recess therein for receiving a permanent magnet. The recess in the outer surface of the brush roll facilitates attachment of the magnet thereto and minimizes the possibility that the magnet will move axially along the brush roll.

In a preferred arrangement, the recess in the outer surface of the brush roll is a circumferential groove and the magnet is carried by a magnet holder ring which is received in the groove.

In another arrangement, the recess in the outer surface of the brush roll is a cylindrical bore that receives a cylindrical magnet.

In a preferred arrangement, the magnet is located on the brush roll in alignment with one of the carpet plate ribs that extend from front-to-rear across the nozzle inlet opening. Brush bristles then are provided on both opposite sides of the magnet between the magnet and both opposite ends of the brush roll.

In one arrangement, the longitudinally-split magnet holder ring is molded of plastic material in an expanded open configuration with spaced-apart ends at the longitudinal split so that the inner and outer ring peripheries do not form continuous circles. The magnet holder ring is contractible to a closed configuration by moving the ends toward one another while semi-circular inner and outer ring peripheral portions move together and provide circular inner and outer ring peripheries. This facilitates movement of the expanded magnet holder ring over the brush roll and contraction of same into the circumferential groove.

In another arrangement, the magnet holder ring is molded of plastic material with circular inner and outer peripheries and a longitudinal split. The ring is expandable by moving the ends away from one another so that the inner and outer peripheries are non-circular. This facilitates movement of the magnet holder ring over the brush roll into alignment with the groove so that the expansion force can be released for allowing the ring to contract into the groove.

Fastening devices may be provided on the opposite end portions of the magnet holder ring for holding same together or for attaching same to the brush roll. In addition, the inner periphery of the magnet holder ring and the opposite end faces thereof may have ribs thereon that cooperate with the bottom and sides of the groove in the brush roll to prevent rotation of the magnet holder ring relative to the brush roll.

It is a principal object of the present invention to provide an improved arrangement for attaching magnets to vacuum cleaner brush rolls.

It is also an object of the invention to provide an improved location for a magnet on a vacuum cleaner brush roll with respect to a vacuum cleaner carpet plate.

It is a further object of the invention to provide an improved magnet holder ring for attaching a magnet to a vacuum cleaner brush roll.

It is an additional object of the invention to provide a location of a magnet on a vacuum cleaner brush roll that improves edge cleaning and positioning of brush bristles on both sides of the magnet along the brush roll.

DESCRIPTION OF PREFERRED EMBODIMENT

Figure 1:
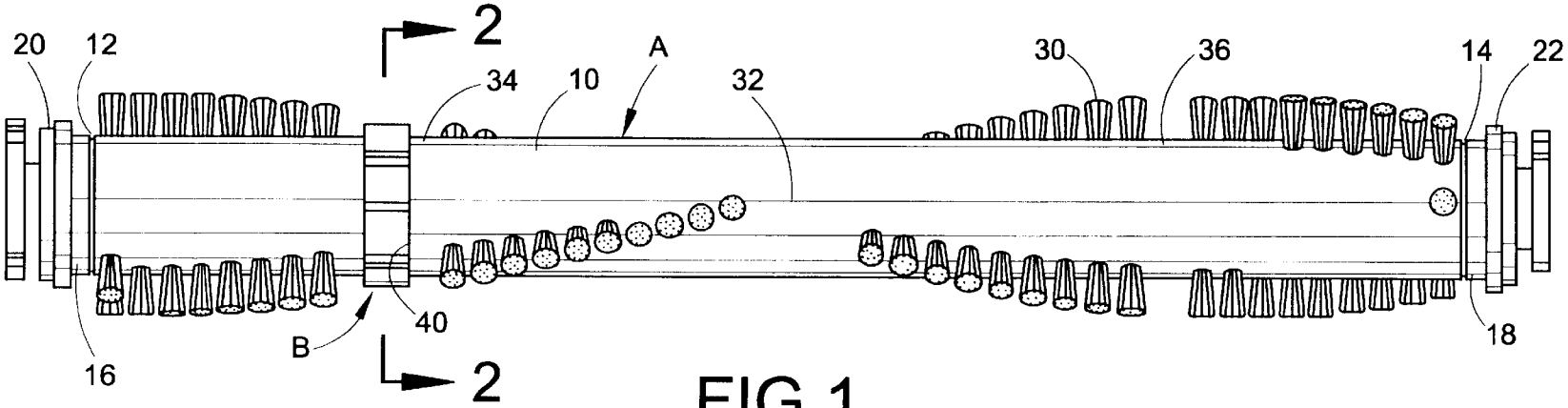
FIG. 1 is a side elevational view of a vacuum cleaner brush roll having a magnet holder positioned thereon in accordance with the present application.

Referring now to the drawing, wherein the showings are for purposes of illustrating certain preferred embodiments of the invention only and not for purposes of limiting same, FIG. 1 shows a vacuum cleaner brush roll A having a cylindrical outer surface 10 with opposite ends 12, 14. Although brush roll A is made from a cylindrical wooden dowel in a preferred embodiment, it will be recognized that other materials including plastic could be used.

The opposite end portions of brush roll A have a reduced diameter for accommodating metal ferrule thread guards 16, 18 as shown and described in U.S. Pat. No. 5,193,243 issued Mar. 16, 1993 to Stegens, and assigned to the same assignee as the present application. The disclosure of the Stegens patent is hereby incorporated herein by reference. Also as disclosed in the Stegens patent, stub shafts extend axially from the opposite ends of brush roll A and receive inner rings of bearings. End caps 20, 22 snap on to the outer rings of the bearings and are attachable within a nozzle of a vacuum cleaner so that brush roll A and the inner bearing rings rotate relative to the end caps 20, 22 and the outer bearing rings by virtue of rolling elements that are interposed between the inner and outer bearing rings.

Brush roll A has a plurality of radial cylindrical bores along the length thereof for receiving tufts of brush bristles 30 arranged in a desirable pattern in a known manner. The brush bristles are interrupted at the central portion of brush roll A as generally indicated at 32 for accommodating a drive belt. The brush bristles also are interrupted as generally indicated at 34 and 36 in alignment with front-to-rear ribs on a carpet plate that is attached to the periphery of the nozzle inlet opening.

A magnet holder ring B is positioned around brush roll A within a circumferential groove 40 that extends inwardly of brush roll cylindrical outer surface 10. The circumferential groove and magnet holder ring are located in the area 34 that is devoid of bristles and that is aligned with a front-to-rear rib on the carpet plate. Thus, brush bristles are located on both opposite sides of magnet holder ring B, and between magnet holder ring B and both of opposite ends 12, 14.

Figure 2:
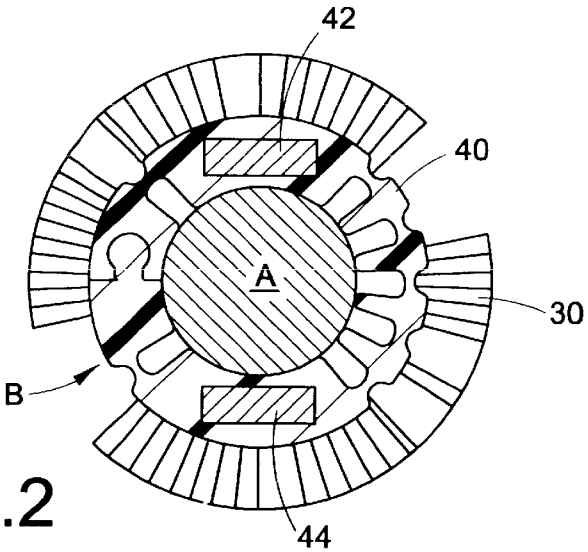
FIG. 2 is a cross-sectional elevational view taking generally on line 2—2 of FIG. 1.

As shown in FIG. 2, a pair of opposite permanent magnets 42, 44 are carried by magnet ring B and attached to brush roll A in circumferential groove 40 by magnet holder ring B. One magnet has its north magnet pole facing radially outwardly of the brush roll while the opposite magnet has its south magnet pole facing radially outwardly of the brush roll so that the polarity of the magnetic poles alternate as the brush roll rotates. It also is possible to provide only one permanent magnet, such as magnet 42, with the other item 44 simply being a nonmagnetic counterbalance weight.

Figure 3:
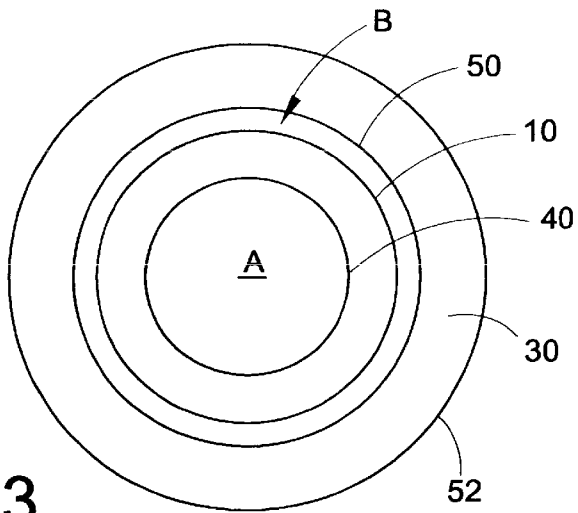
FIG. 3 is an end elevational schematic showing the location of various surfaces on a vacuum cleaner brush roll and a magnet holder ring in accordance with the present application.

FIG. 3 shows the relationship between various surfaces on the brush roll. The inner circle represents the bottom of circumferential groove 40 which is below brush roll cylindrical outer surface 10. Numeral 50 designates the outer periphery of magnet holder ring B while numeral 52 designates the cylindrical periphery of the path traversed by the ends of brush bristles 30 as the brush roll rotates.

It will be recognized that dimensions may vary considerably within the spirit of the present invention and typical dimensions will be given simply by way of example. The diameter of the bottom of groove 40 is approximately 0.9 inch which corresponds to the diameter of the inner periphery of magnet holder ring B. The diameter of cylindrical outer surface 10 of brush roll A is approximately 1.333 inches. The diameter of the outer periphery 50 of magnet holder ring B is approximately 1.544 inches. The diameter of the cylindrical periphery 52 traversed by the brush bristle ends is approximately 2.126 inches.

With these example dimensions, the depth of circumferential groove 40 from brush roll cylindrical outer surface 10 to the groove bottom is approximately 0.2165 inch. The radial thickness of the magnet holder ring between its inner and outer peripheries is approximately 0.322 inch. The radial distance from outer surface B of magnet holder ring 50 to the cylindrical path 52 traversed by the brush bristle ends is approximately 0.291 inch. Thus, the radial thickness of magnet holder ring B is greater than the depth of groove 40 so that magnet holder ring outer periphery 50 is spaced outwardly from brush roll cylindrical outer surface 10. The depth of groove 40 is much greater than one-half the radial thickness of magnet holder ring B so that a major portion of the ring thickness is received within the groove.

Outer periphery 50 of magnet holder ring B is positioned much closer to brush roll cylindrical outer surface 10 than to cylindrical path 50 traversed by the brush bristle ends. In the example provided, outer periphery 50 of magnet holder ring B is spaced approximately 0.1055 inch outwardly from brush roll cylindrical outer surface 10 and is spaced approximately 0.291 inch inwardly from cylindrical path 52 traversed by the brush bristle ends.

It will be recognized that in some arrangements the magnet holder ring can be secured directly to the cylindrical outer surface of the brush roll instead of being positioned within a circumferential groove. This is particularly so when the magnet holder ring is aligned with one of the carpet plate ribs or when an additional fastener is used to secure the magnet holder ring in position on the brush roll. In other arrangements, the outer periphery of the magnet holder ring may be flush with the outer surface of the brush roll or located entirely within the circumferential groove.

Figure 4:
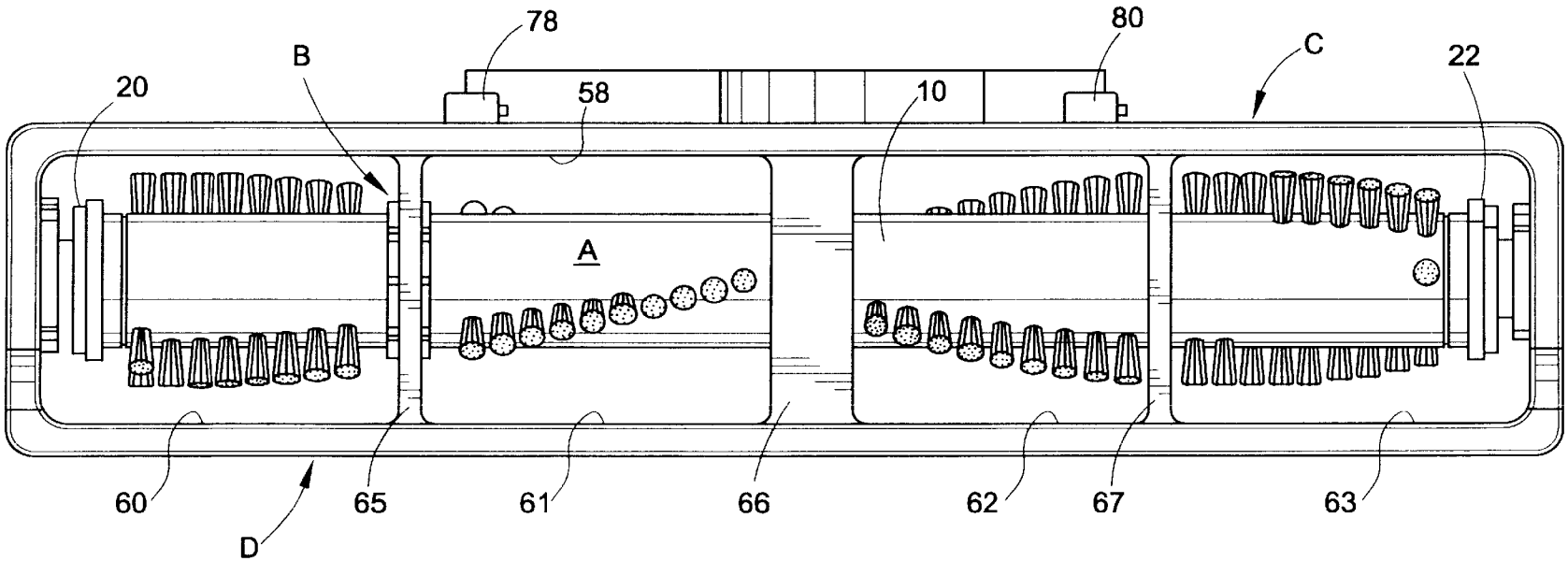
FIG. 4 is a view looking into the inlet opening of a vacuum cleaner nozzle having a brush roll mounted therein.

FIG. 4 shows a vacuum cleaner nozzle C having a generally rectangular inlet opening 58. Brush roll A is rotatably mounted within nozzle C adjacent to opening 58 and a carpet plate D is attached to nozzle C around the periphery of opening 58. Carpet plate D has a plurality of rectangular openings 60–63 that extend along the length of brush roll A and are separated by front-to-rear ribs 65, 66 and 67. Ribs 65–67 help the nozzle to float on a carpet instead of being drawn tightly thereagainst by the vacuum within nozzle C during operation of the vacuum cleaner.

The carpet plate ribs effectively divide nozzle inlet opening 58 into a plurality of individual openings extending along the length of the brush roll. Central rib 66 is aligned with the drive belt for brush roll A and, in the arrangement shown, the magnet holder ring of the present application is aligned with carpet plate rib 65. The carpet plate ribs are spaced-apart along the length of the brush roll and also are spaced inwardly from the opposite ends of nozzle opening 58 and from the opposite ends of the carpet plate. The carpet plate ribs preferably lie in planes that extend perpendicular to the longitudinal axis of the brush roll.

Figure 5:
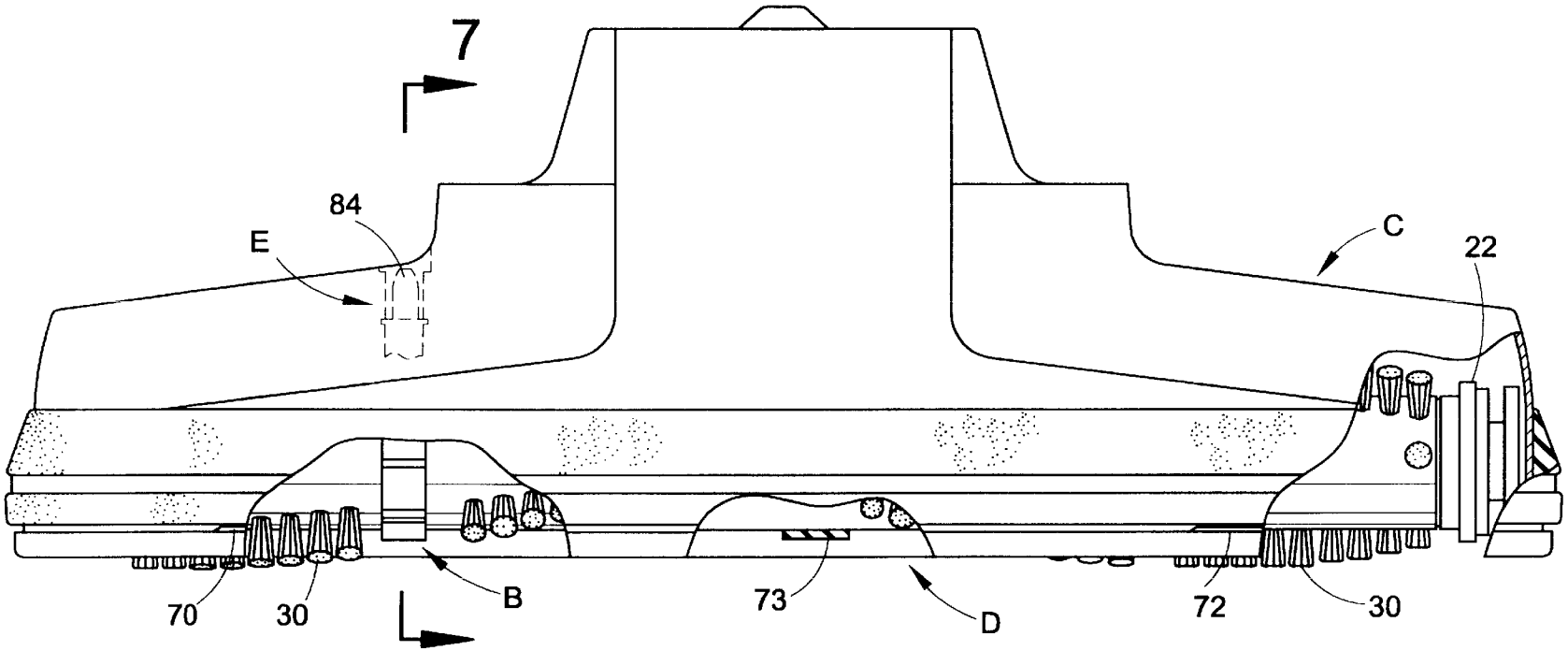
FIG. 5 is a front elevational view of a vacuum cleaner nozzle having the brush roll of the present application incorporated therein.
Figure 6:
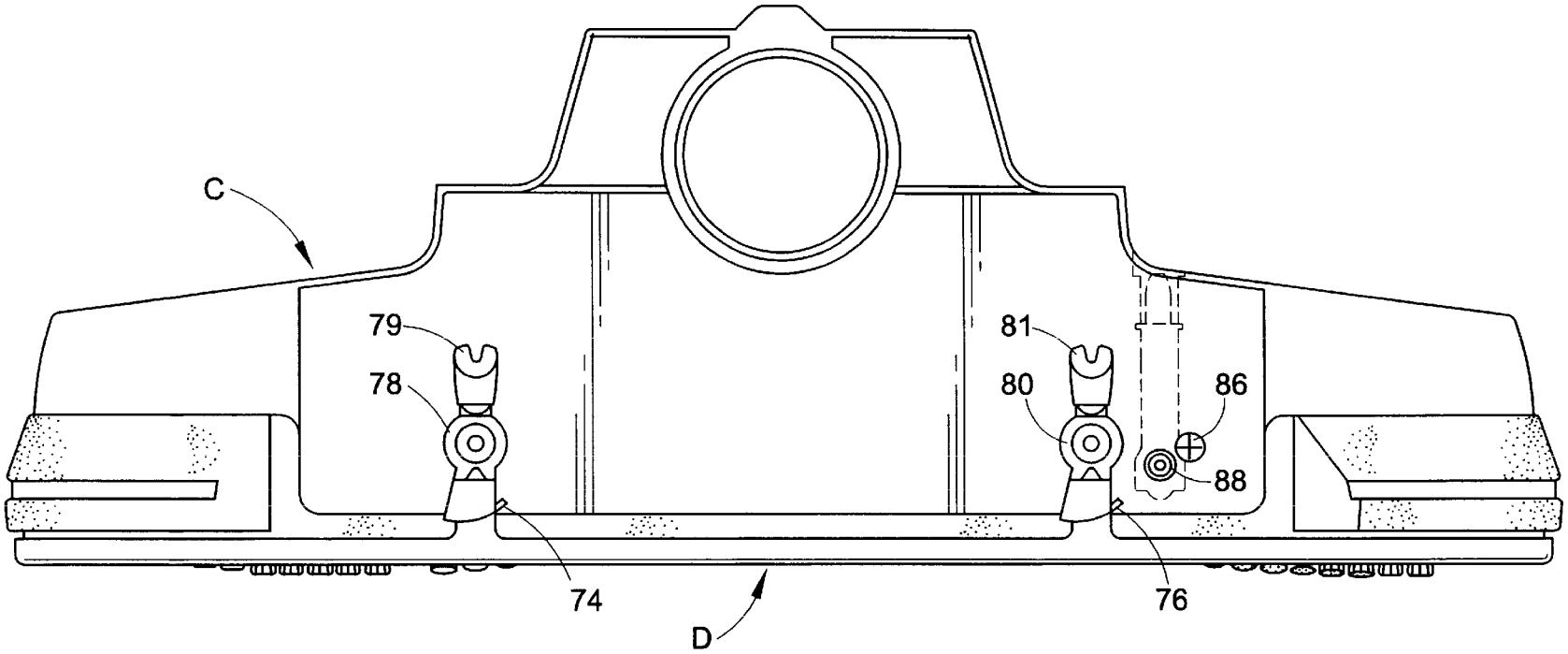
FIG. 6 is a rear elevational view of the nozzle of FIG. 5.

As shown in FIG. 5, carpet plate D has front hooks 70, 72 that project toward nozzle C and engage within recesses adjacent the periphery of the nozzle opening. The rear of carpet plate D has latch projections 74, 76 thereon for cooperation with latches 78, 80 as shown in FIG. 6 for releaseably retaining carpet plate D on nozzle C. Latches 78, 80 have handles 79, 81 for use in opening and closing the latches. A drive belt 73 extends around the brush roll and a motor output shaft for rotating the brush roll in a known manner.

Figure 7:
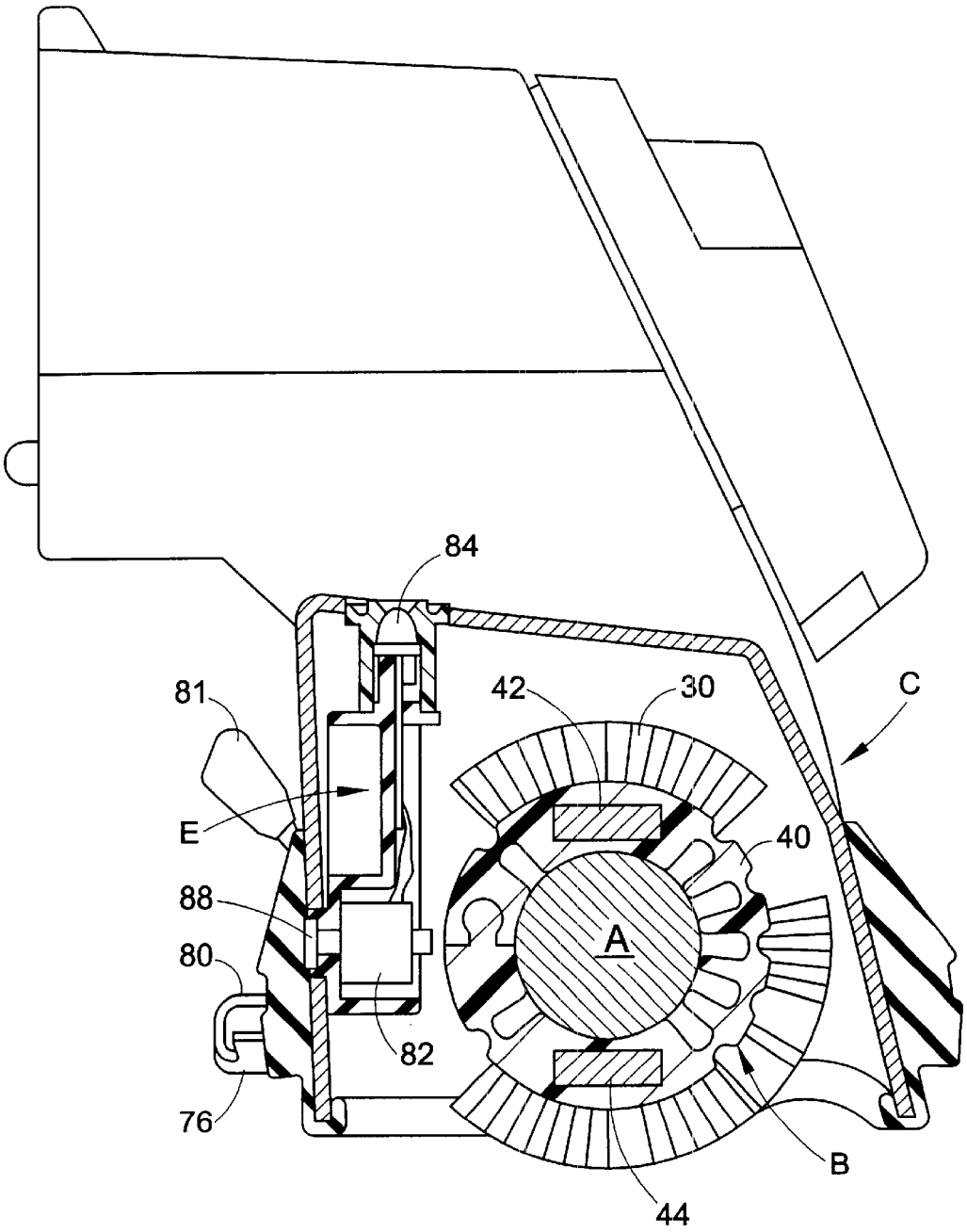
FIG. 7 is a cross-sectional elevational view taken generally on line 7—7 of FIG. 5.

During rotation of the magnet with the brush roll, magnetic flux licks a coil 82 in FIG. 7 to generate a voltage for energizing an electrical component 84 such as a light emitting diode. The coil and light are mounted on a bracket E that is secured within nozzle C to the back wall thereof by screw 86 as shown in FIG. 6. An enlarged head on a rivet 88 that extends through coil 82 projects through a suitable hole in the back wall of the nozzle adjacent screw 86 for positioning the bracket E and preventing rotation thereof about screw 86. More details of the coil and light may be found in U.S. Pat. No. 4,692,754 issued Sep. 8, 1987, to Edejer et al and assigned to the same assignee as the present application. The disclosure of the Edejer et al patent is hereby incorporated herein by reference.

Figure 8:
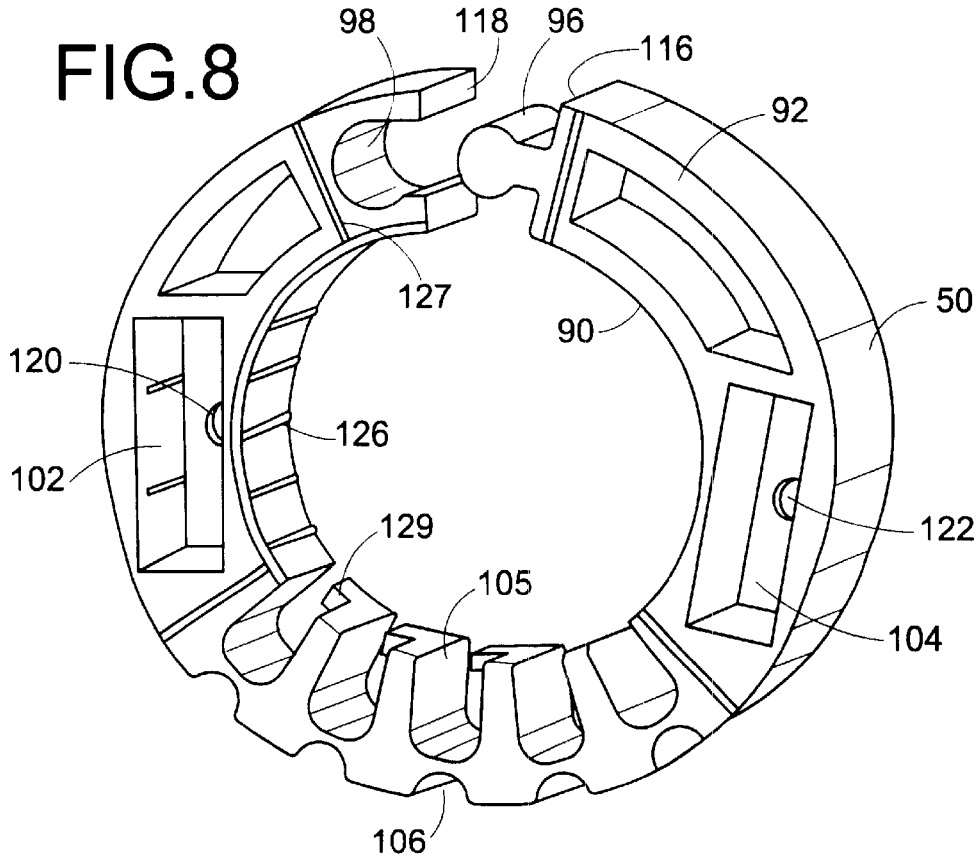
FIG. 8 is a perspective illustration of a magnet holder ring in accordance with the present application.
Figure 9:
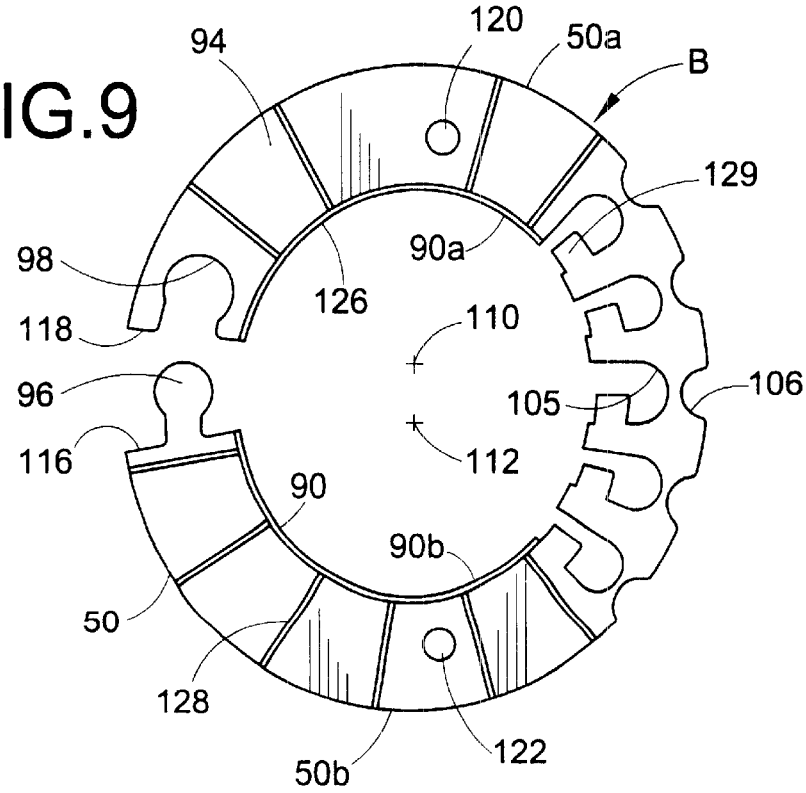
FIG. 9 is an end elevational view of the magnet holder ring of FIG. 8.
Figure 10:
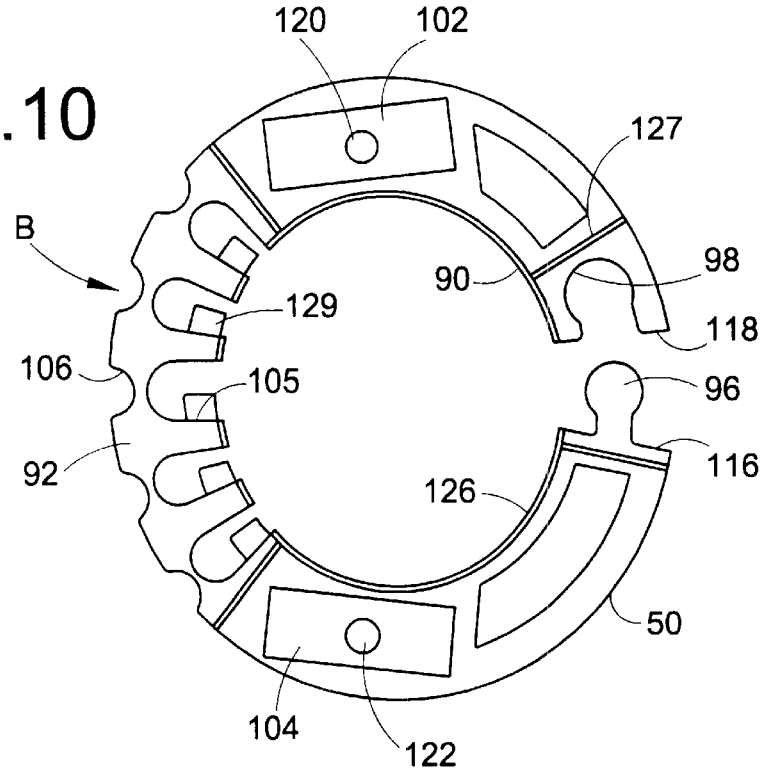
FIG. 10 is an end elevational view showing the opposite end of the magnet holder of FIGS. 8 and 9.

FIGS. 8–10 show magnet holder ring B molded in one-piece of plastic material and having outer and inner peripheries 50, 90, and opposite end faces 92, 94. Ring B is longitudinally split and has an interlocking projection and recess 96, 98 at the ends thereof that snap together. Magnet receiving pockets 102, 104 in end face 92 receive permanent magnets 42, 44 of FIG. 2.

A plurality of circumferentially-spaced radial slots extend outwardly from inner periphery 90 generally opposite from projection and recess 96, 98 and only one such slot is indicated by numeral 105. Shallower external grooves 106 extend inwardly from outer periphery 50 opposite from inner slots 104. These internal slots and external grooves facilitate bending of ring B for snapping projection 96 and recess 98 together.

Magnet holder ring B is molded in a non-circular configuration as shown in the figures. Both outer and inner peripheries 50, 90 are curved about two different spaced-apart centers 110 and 112 in FIG. 9. Thus, outer peripheral surface portion 50*a* is curved about center 110 at a radius of approximately 0.772 inch while outer peripheral surface portion 50*b* is curved about center 112 at a radius of approximately 0.772 inch. Likewise, inner peripheral surface portion 90*a* is curved about center 110 at a radius of approximately 0.455 inch while inner peripheral surface portion 90*b* is curved about center 112 at a radius of approximately 0.455 inch. In the as-molded condition, ends 116 and 118 from which projection 96 and recess 98 extend are spaced-apart approximately 18°. When projection 96 and recess 98 are snapped together, the inner and outer peripheries of the brush holder ring are approximately circular.

Holes 120, 122 are provided through end face 94 in alignment with magnet receiving pockets 102, 104 so that a pin can be inserted through the hole to eject a magnet that has been improperly positioned within a pocket. A plurality of circumferentially-spaced ribs extend inwardly from inner periphery 90 to engage the bottom of the groove on the brush roll and prevent relative rotation between the brush roll and the magnet holder ring. Only one of such ribs is generally indicated by numeral 126 in the drawing.

A plurality of circumferentially-spaced ribs also are provided on opposite faces 92, 94 extending generally radially of the magnet ring. Only one such rib is indicated at 127 on face 92 and at 128 on face 94. These ribs engage the opposite sides of brush roll groove 40 to prevent relative movement between the ring and the brush roll.

A projection extends generally circumferentially part way across each slot 105 adjacent inner periphery 90 of magnet ring B. Only one such projection is indicated by a numeral at 129. The projections 129 prevent complete closing of any individual slot to insure that contraction of magnet ring B will occur by partial closing of a plurality of slots 105. Projections 129 also help to stabilize magnet ring B.

Figure 11:
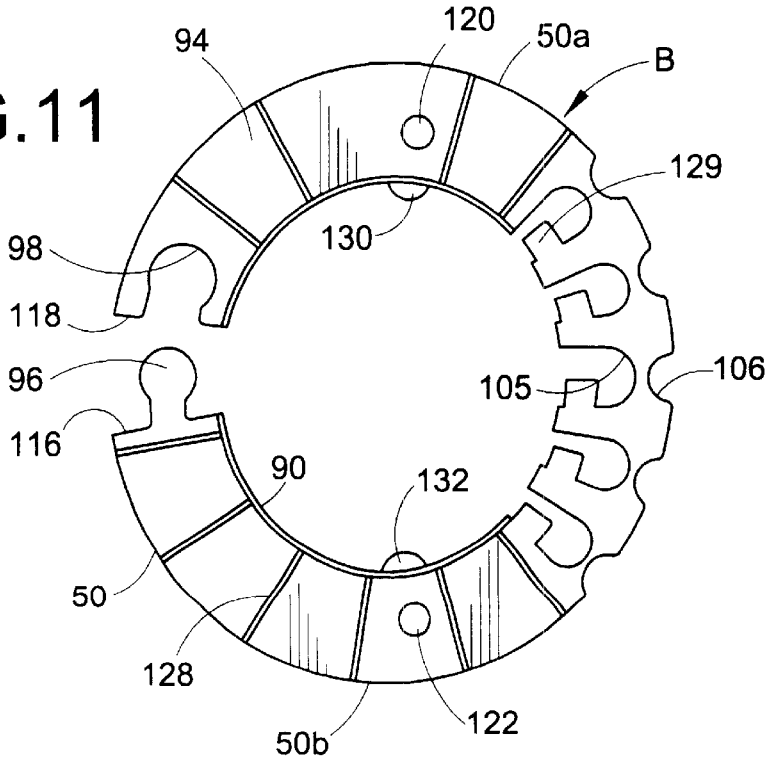
FIG. 11 is a view similar to FIG. 9 and showing a modification.
Figure 12:
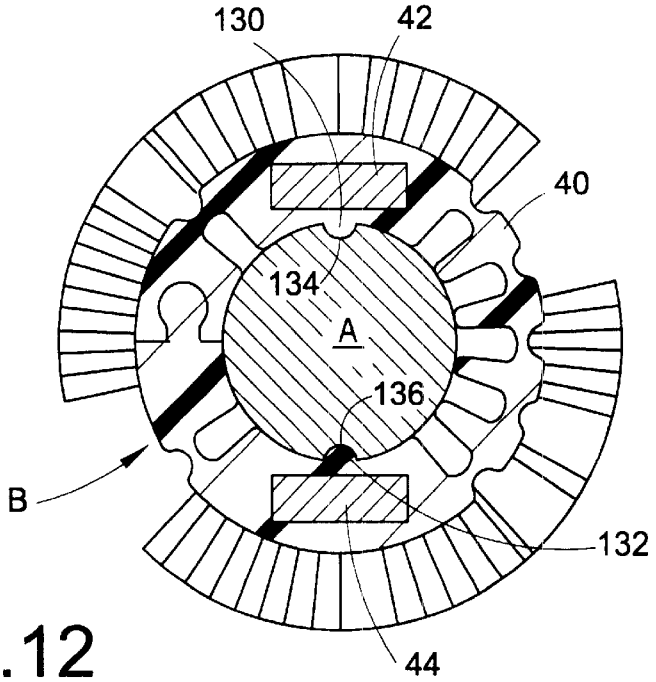
FIG. 12 is a cross-sectional elevational view similar to FIG. 2 and showing the magnet holder ring of FIG. 11.

FIGS. 11 and 12 show another arrangement wherein inner periphery 90 of brush holder ring B has a pair of opposite projections 130, 132 extending inwardly therefrom for reception in recesses 134, 136 at the bottom of circumferential groove 40 in brush roll A. This arrangement further locks the ring against rotation relative to the brush roll.

Figure 13:
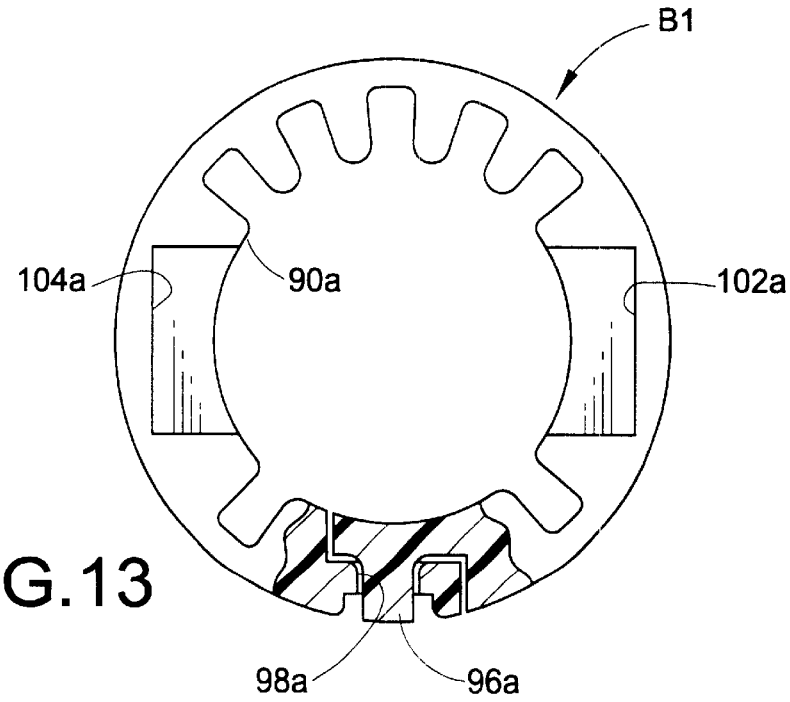
FIG. 13 is an end elevational view of another magnet holder ring with the end portions cut-away and in section for clarity of illustration.

FIG. 13 shows another arrangement wherein a magnet holder ring B1 having magnet receiving pockets 102*a*, 104*a* has overlapping end portions with a radially extending projection 96*a* on one end portion received through a radially extending hole 98*a* on the other end portion. The ring is deformable to disengage the projection from the recess and expand the ring outwardly for movement over the outer cylindrical surface of a brush roll until the ring is aligned with the desired location whereupon the expanding force is released to allow the ring to contract into engagement with the brush roll or into the groove.

Figure 14:
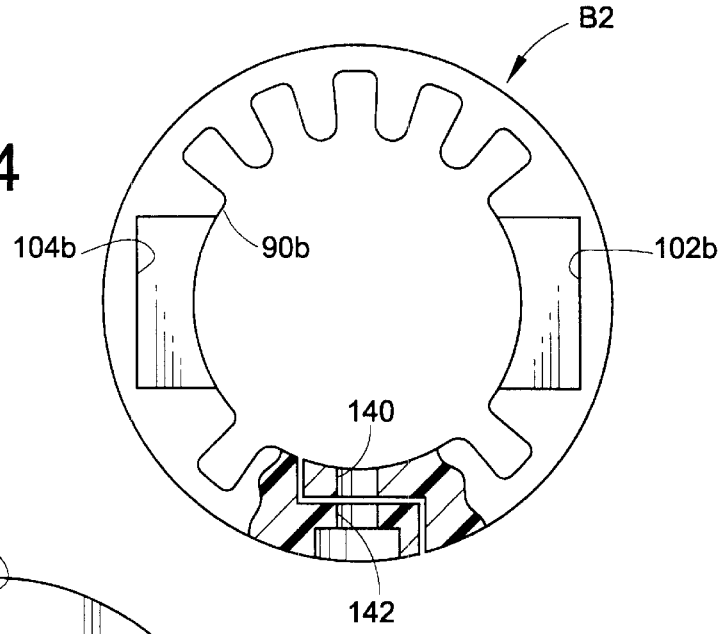
FIG. 14 is an end elevational view of another magnet holder ring with the end portions thereof cut-away and in section for clarity of illustration.

FIG. 14 shows another arrangement wherein magnet holder ring B2 with magnet receiving pockets 102*b*, 104*b* has overlapping end portions with aligned radial holes 140, 142 therethrough for receiving a screw, rivet or other fastener that extends into a bore in the brush roll for securing the ring to the brush roll and preventing expansion of the ring.

Figure 15:
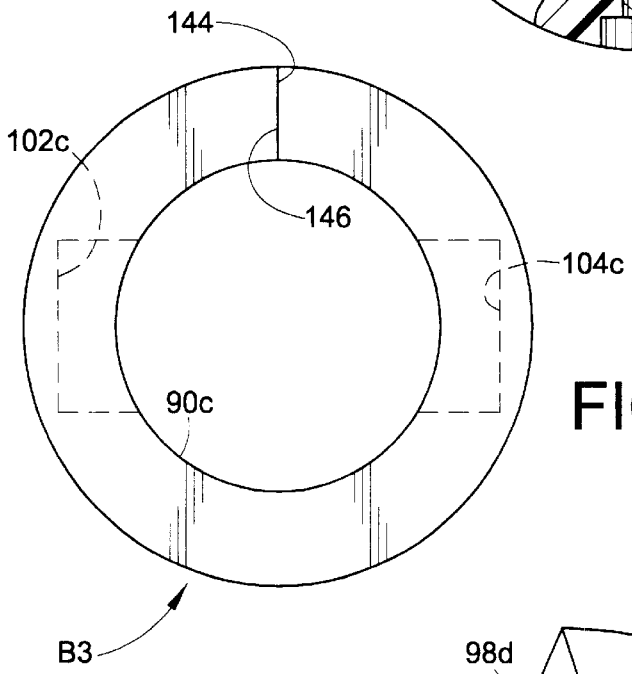
FIG. 15 is an end elevational view of another magnet holder ring.

FIG. 15 shows another arrangement wherein magnet holder ring B3 with magnet receiving pockets 102*c*, 104*c* simply has flat ends 144, 146 that do not overlap or interlock in any manner.

Figure 17:
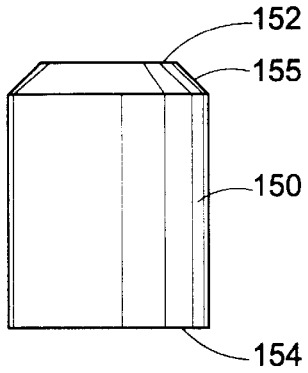
FIG. 17 is a front elevational view of a magnet.

FIG. 17 shows another arrangement wherein a semi-circular magnet ring segment B4 has a magnet receiving pocket 102*d* with a projection 96*d* extending outwardly from one end and a socket 98*d* extending inwardly from the other end. A pair of the semi-circular members B4 are reversely positioned relative to one another with the projection 96*d* on each received in the socket 98*d* of the other.

Figure 16:
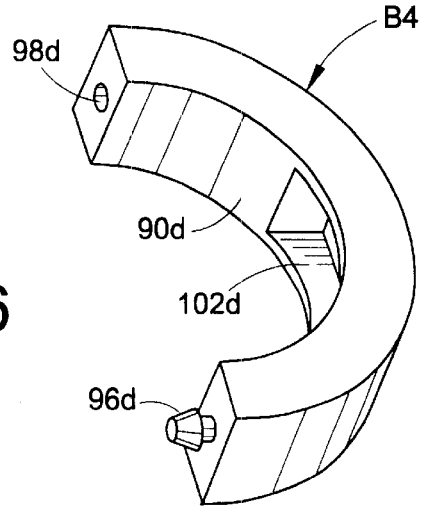
FIG. 16 is a perspective illustration of one-half of another magnet holder ring.

In the arrangements of FIGS. 8–11, the magnet receiving pockets 102, 104 open outwardly only at one end face 92. In the arrangements of FIGS. 13 and 14, the magnet receiving pockets open outwardly both at the inner periphery 90*a*, 90*b* of the ring as well as at one end face thereof. In the arrangements of FIGS. 15 and 16, the magnet receiving pockets open outwardly only at inner periphery 90*c*, 90*d* thereof.

Figure 19:
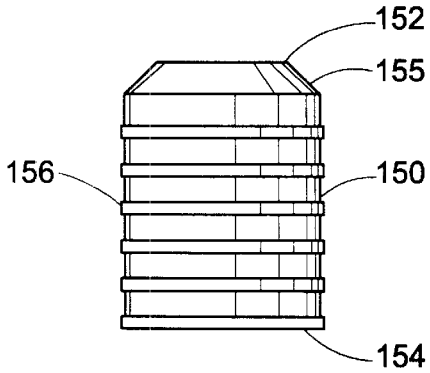
FIG. 19 is a front elevational view of another magnet.
Figure 18:
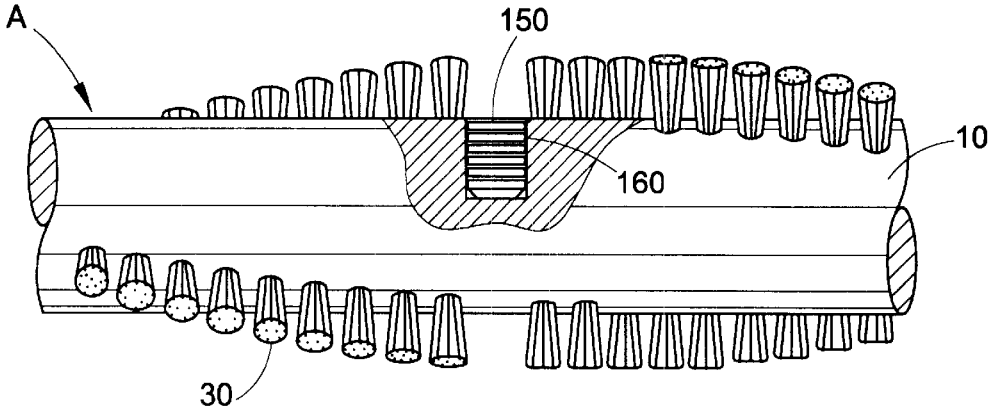
FIG. 18 is a front elevational view of a brush roll with a portion thereof cut-away and in section to show the magnet of FIG. 18 attached thereto.

FIGS. 17–19 show another arrangement wherein a cylindrical magnet 150 has end magnetic poles 152, 154 of opposite magnetic polarity. A cylindrical bore 160 in brush roll A is dimensioned for receiving magnet 150 with a force fit or pressed fit. One end portion of magnet 150 may be tapered as generally indicated at 155 to facilitate insertion of the magnet into the cylindrical bore.

The arrangement of FIG. 19 is similar to FIG. 17 with the addition of outwardly extending circumferential ribs 156 on the magnet that bite into the periphery of the brush roll bore for better securement of the magnet within the bore.

Figure 20:
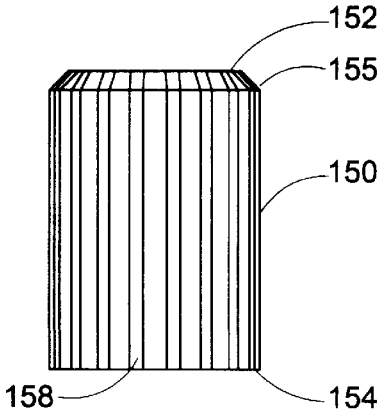
FIG. 20 is a front elevational view of another magnet.

FIG. 20 is another arrangement similar to FIGS. 17 and 18 with the addition of a plurality of longitudinally-extending circumferentially-spaced ribs 158 that bite into the periphery of brush roll bore 160 to hold the magnet more securely within the bore.

Figure 21:
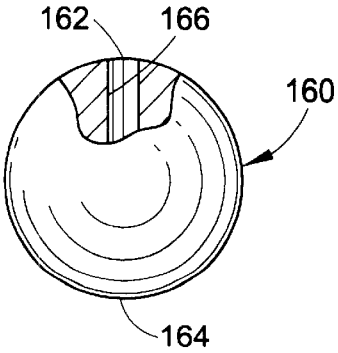
FIG. 21 is a front elevational view of another magnet.

FIG. 21 shows another arrangement similar to FIGS. 17 and 18 wherein magnet 160 is spherical with opposite magnetic poles 162, 164 and a central hole 166 extending therebetween for receiving a fastener that extends into the brush roll at the bottom of magnet receiving bore 160 of FIG. 18.

In all of the magnet holder embodiments, it will be recognized that adhesive also may be used for securing the magnet holder ring to the brush roll or within the groove. In addition, both the circumferential groove and the cylindrical bore are special forms of recesses in which the magnet is positioned for securing same to the brush roll. In preferred embodiments, the magnet is attached to the brush roll in a recess that is formed in the cylindrical outer surface of the brush roll. In one arrangement the recess is a circumferential groove and in another arrangement the recess is a cylindrical bore. Obviously, other recess shapes also may be provided. In some situations, the brush holder ring may be attached directly to the cylindrical outer surface of the brush roll in alignment with one of the carpet plate ribs.

Although the invention has been shown and described with reference to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. In a vacuum cleaner nozzle having an inlet opening, a brush roll mounted within said nozzle adjacent said inlet opening, a carpet plate attached to said nozzle and extending along said nozzle inlet opening, said carpet plate having a plurality of openings therein extending in a direction along the length of said brush roll, said carpet plate openings being separated by ribs, the improvement comprising:

a permanent magnet attached to said brush roll in alignment with one of said ribs.

2. The nozzle of claim 1 wherein said brush roll has a cylindrical brush roll outer surface with a recess therein receiving said magnet.

3. The nozzle of claim 2 wherein said recess comprises a bore in which said magnet is received with a pressed fit.

4. The nozzle of claim 2 wherein said recess comprises a circumferential groove and said magnet is on a ring that is received in said groove.

5. The nozzle of claim 4 wherein said ring is longitudinally split and is expandable to an internal size for reception over said outer surface while having an internal size when contracted that is smaller than said outer surface for reception of said ring in said groove.

6. A vacuum cleaner brush roll having opposite ends and a cylindrical outer surface, a circumferential groove in said outer surface intermediate said opposite ends, a permanent magnet attached to said brush roll by way of a magnet holding ring that is received in said groove, and brush bristles extending outwardly from said brush roll outer surface between said magnet and both of said opposite ends.

7. The brush roll of claim 6 wherein said ring has at least one longitudinal split therein to provide outward expansion thereof.

8. The brush roll of claim 6 wherein said ring has inner and outer ring peripheries, and a magnet receiving pocket between said ring peripheries.

9. The brush roll of claim 8 wherein said ring has opposite ring end surfaces and said magnet receiving pocket opens outwardly at one of said ring end surfaces.

10. The brush roll of claim 8 wherein said magnet receiving pocket opens outwardly at said ring inner periphery.

11. The brush roll of claim 8 wherein said ring has opposite ring end surfaces and said magnet receiving pocket opens outwardly at both said ring inner periphery and one of said ring end surfaces.

12. The brush roll of claim 6 wherein said groove has a groove depth and said magnet holding ring has a ring thickness that is greater than said groove depth.

13. The brush roll of claim 12 wherein said bristles have bristle ends that traverse a cylindrical path periphery during rotation of said brush roll and said ring has a ring outer periphery lying intermediate said outer surface and said path periphery.

14. The brush roll of claim 13 wherein said ring outer periphery is closer to said outer surface than to said path periphery.

15. The brush roll of claim 6 wherein said magnet holding ring has a longitudinal split therein and said ring has ring end portions that overlap one another circumferentially of said ring adjacent said split.

16. The brush roll of claim 15 wherein said ring end portions have an interlocking projection and recess thereon.

17. The brush roll of claim 15 wherein said ring end portions have aligned fastener receiving holes therethrough.

18. The brush roll of claim 6 wherein said magnet holding ring is longitudinally split into a pair of semi-circular ring halves at least one of which has a magnet receiving pocket therein.

19. The brush roll of claim 18 wherein said ring halves have ring half ends with cooperating projections and recesses thereon to secure said ring halves together.

20. The brush roll of claim 6 wherein said magnet holding ring is longitudinally split with spaced-apart ring ends and non-circular inner and outer ring peripheries, said ring being deformable by moving said ring ends together to provide said ring with circular inner and outer peripheries.

21. A vacuum cleaner brush roll having opposite ends and a cylindrical outer surface, a recess in said outer surface intermediate said opposite ends, a permanent magnet attached to said brush roll by way of said recess, brush bristles extending outwardly from said outer surface between said magnet and both of said opposite ends, a vacuum cleaner nozzle having an inlet opening, said brush roll being mounted within said nozzle adjacent said inlet opening, a carpet plate attached to said nozzle and extending along said inlet opening, said carpet plate having a plurality of plate openings therein extending in a direction between said opposite ends of said brush roll, said plate openings being separated by plate ribs, and said magnet being aligned with one of said ribs.

22. A vacuum cleaner brush roll having opposite ends and a cylindrical outer surface, a bore extending into said brush roll from said outer surface intermediate said opposite ends, a permanent magnet received in said bore, said bore having a bore periphery and said magnet having an outer magnet periphery, said outer magnet periphery having ribs thereon biting into said bore periphery.

23. The brush roll of claim 22 wherein said ribs extend axially of said magnet.

24. The brush roll of claim 22 wherein said ribs extend circumferentially of said magnet.

25. A vacuum cleaner brush roll having opposite ends and a cylindrical outer surface, a circumferential groove in said outer surface intermediate said opposite ends, and a permanent magnet attached to said brush roll by way of a magnet holding ring that is received in said groove.

26. A vacuum cleaner brush roll having opposite ends and a cylindrical outer surface, a cylindrical bore extending into said brush roll from said outer surface intermediate said opposite ends, a generally spherical permanent magnet attached to said brush roll by way of reception in said bore, and brush bristles extending outwardly from said outer surface between said magnet and both of said opposite ends.

27. The brush roll of claim 26 including a fastener receiving opening in said permanent magnet.

28. A vacum cleaner brush roll having opposite ends and a cylindrical outer surface, a cylindrical bore extending into said brush roll from said outer surface intermediate said opposite ends, and generally spherical permanent magnet attached to said brush roll by way of reception in said bore.

29. The brush roll of claim 28 including a fastener securing said permanent magnet to said brush roll in said bore.

30. The brush roll of claim 29 wherein said permanent magnet has a hole therethrough and said fastener extends through said hole.

31. A vacuum cleaner brush roll having opposite ends and a cylindrical outer surface, a cylindrical bore extending into said brush roll from said outer surface intermediate said opposite ends, and generally spherical permanent magnet received in said bore.

32. The brush roll of claim 31 including a fastener securing said permanent magnet to said brush roll in said bore.

33. The brush roll of claim 32 wherein said permanent magnet has a hole therethrough and said fastener extends through said hole.

* * * * *